US007585105B2

(12) United States Patent
Reinecke

(10) Patent No.: US 7,585,105 B2
(45) Date of Patent: Sep. 8, 2009

(54) SCRAPER ASSEMBLY

(75) Inventor: Tim V. Reinecke, Burnett, WI (US)

(73) Assignee: Apache Stainless Equipment Corporation, Beaver Dam, WI (US)

( * ) Notice: Subject to any disclaimer, the term of this patent is extended or adjusted under 35 U.S.C. 154(b) by 666 days.

(21) Appl. No.: 11/446,703

(22) Filed: Jun. 5, 2006

(65) Prior Publication Data

US 2007/0280045 A1 Dec. 6, 2007

(51) Int. Cl.
*B01F 7/08* (2006.01)

(52) U.S. Cl. ..... 366/309; 366/312; 366/320; 366/325.5; 99/348

(58) Field of Classification Search ..... 366/309, 366/310, 312, 313, 325.3, 325.4, 325.5, 320; 99/348

See application file for complete search history.

(56) References Cited

U.S. PATENT DOCUMENTS

| | | | | | |
|---|---|---|---|---|---|
| 2,282,298 | A * | 5/1942 | Vogel | 366/312 |
| 2,538,716 | A * | 1/1951 | Wakeman | 366/309 |
| 2,831,665 | A * | 4/1958 | Baerfuss | 366/312 |
| 3,641,783 | A * | 2/1972 | Werner | 62/343 |
| 4,515,483 | A * | 5/1985 | Muller et al. | 366/312 |
| 4,571,091 | A * | 2/1986 | Pardo et al. | 366/312 |
| 4,660,987 | A * | 4/1987 | Robinson | 366/325.3 |
| 4,733,607 | A | 3/1988 | Star et al. | |
| 4,790,667 | A * | 12/1988 | Pardo et al. | 366/312 |
| 4,818,116 | A * | 4/1989 | Pardo et al. | 366/311 |
| 4,941,132 | A | 7/1990 | Horn et al. | |
| 4,952,069 | A * | 8/1990 | Boulard | 366/312 |
| 5,074,125 | A * | 12/1991 | Schifferly | 62/342 |
| 5,083,506 | A | 1/1992 | Horn et al. | |
| 5,228,775 | A | 7/1993 | Horn et al. | |
| 5,876,115 | A * | 3/1999 | Schebesta et al. | 366/97 |
| 6,578,468 | B1 | 6/2003 | Horn | |
| 6,694,867 | B1 * | 2/2004 | Roth | 99/348 |
| 7,237,944 | B2 * | 7/2007 | Hardy et al. | 366/311 |
| 7,248,823 | B2 * | 7/2007 | Buhay-Kettelkamp et al. | 366/320 |
| 2006/0062078 | A1 * | 3/2006 | Jejcic | 366/325.94 |
| 2006/0158960 | A1 * | 7/2006 | Wu | 366/320 |
| 2007/0140053 | A1 * | 6/2007 | Jejcic | 366/312 |
| 2007/0280045 | A1 * | 12/2007 | Reinecke | 366/312 |

FOREIGN PATENT DOCUMENTS

WO WO 2007/143619 * 12/2007

* cited by examiner

*Primary Examiner*—Tony G Soohoo
(74) *Attorney, Agent, or Firm*—McAndrews, Held & Malloy, Ltd.

(57) ABSTRACT

Certain embodiments of the present invention provide a scraper assembly. For example, in one embodiment, a scraper assembly comprises: a substantially rigid member; a pin with a first end and a second end, wherein a tab protrudes from a side of the first end and the second end is attached to the substantially rigid member; a scraper head with a hole therethrough that is large enough to receive the pin, wherein the scraper head has a first channel that runs the depth of the scraper head and is large enough to receive the tab, and wherein the scraper head has a second channel that does not run the depth of the scraper head and is large enough to receive the tab; and a coil spring, wherein the coil spring is disposed around the pin and is held captive between the substantially rigid member and the scraper head.

20 Claims, 6 Drawing Sheets

SCRAPER ASSEMBLY

BACKGROUND OF THE INVENTION

The technology of the present invention generally relates to scraper assemblies and methods for assembling scraper assemblies. Particularly, the present technology relates to scraper assemblies used in commercial blending and/or cooking systems and methods for assembling such scraper assemblies.

Commercial blending and/or cooking systems are known in the food preparation industry and other industries. For example, U.S. Pat. No. 4,733,607 (the "'607 patent"), which issued to Star et al. on Mar. 29, 1988, and is entitled Food Processing Machine, describes "[a] mixer for food products and the like in commercial quantities [that] comprises a horizontally elongated body with a trough bottom in which rotates one or more horizontal drive shafts carrying an agitator in the form of a helical ribbon or worm of a radius matching that of the trough bottom. The ribbon supports a number of scraper units on it, each scraper unit including a scraper body having a broad face facing toward the trough bottom, the broad face terminating in two opposed relatively sharp edges. The scraper bodies are mounted for rocking movement so that the leading edge will be forced into scraping engagement with the trough bottom and will remain in engagement with the trough bottom even though the trough is wavy or uneven. Either of the edges of the scraper body can be the leading edge, depending on the direction of rotation of the agitator drive shaft." ('607 patent at Abstract.)

In another example, U.S. Pat. No. 5,228,775 (the "'775 patent"), which issued to Horn et al. on Jul. 20, 1995, and is entitled Reversing Blender Agitators, describes "[i]mproved methods of operating batch or continuous blenders having tub and two agitators extending parallel to each other, each agitator having horizontal shaft and agitator ribbon wound helically around the shaft." ('775 patent at Abstract (references to Figures omitted).) The '775 patent further states, "The agitators are rotated in opposite directions to fold the product into the center of the tub for mixing, with both agitators moving the product in the same direction lengthwise in the tub. The agitators' rotation direction is periodically reversed, with the time of reversed operation in each cycle being less than the time of forward operation, so that the product as a whole progressively moves toward discharge end of the blender as the product is being mixed. When needed, scrapers are attached to the agitator ribbons to scrape the wall of the tub upon rotation of the agitators in either direction." ('775 patent at Abstract (references to Figures omitted).)

Although scraper assemblies that are currently available provide a certain degree of effectiveness, they have shortcomings. For example, currently available scraper assemblies allow for potential contamination and/or reduced productivity. Particularly, currently available scraper assemblies have spaces where food can get stuck, and may not be readily removed without deconstructing the scraper assembly. This can result in the contamination of new food items with remnants of previously processed food items and/or reduced productivity due to an increased need for system maintenance, such as removal and cleaning of scraper assemblies, which oftentimes requires special tools, such as a torque wrench.

Further, some scraper assembly designs have many discrete parts that can come loose and eventually become mixed in with food items. This creates the potential for downstream contamination in systems that feed into larger repositories as well as the potential to damage equipment used in commercial blending and/or cooking systems.

Finally, scraper assembly designs known in the art do not sufficiently maintain contact between scraper heads and the inner surface of tubs, which results in uneven scraping and increased sticking of substances, such as food items, to the inner surface of tubs.

Thus, there is a need for an improved scraper assembly for use in commercial blending and/or cooking systems. Particularly, for a scraper assembly that reduces the risk of contamination, scrapes tubs more evenly and allows for easier removal and/or replacement of scraper assembly components.

BRIEF SUMMARY OF THE INVENTION

Certain embodiments of the present invention provide a scraper assembly for use in a blending system and a method for assembling a scraper assembly. For example, in one embodiment, a scraper assembly for use in a blending system comprises: a substantially rigid member; a pin with a first end and a second end, wherein a tab protrudes from a side of the first end and the second end is attached to the substantially rigid member; a scraper head having at least one scraping surface, wherein the scraper head has a hole therethrough that is large enough to receive the pin, wherein the scraper head has a first channel that runs the depth of the scraper head and is large enough to receive the tab, and wherein the scraper head has a second channel that does not run the depth of the scraper head and is large enough to receive the tab; and a coil spring, wherein the coil spring is disposed around the pin and is held captive between the substantially rigid member and the scraper head.

As another example, one embodiment of a blending system comprises: a tub having an inner surface; an agitator having a shaft and a ribbon wound helically around the shaft, wherein the agitator is disposed within the tub such that the agitator can be rotated about the shaft without contacting the inner surface of the tub; and a scraper assembly comprising: a substantially rigid member, wherein the substantially rigid member is attached to the ribbon; a pin with a first end and a second end, wherein a tab protrudes from a side of the first end and the second end is attached to the substantially rigid member; a scraper head having at least one scraping surface, wherein the scraping surface contacts the inner surface of the tub, wherein the scraper head has a hole therethrough that is large enough to receive the pin, wherein the scraper head has a first channel that runs the depth of the scraper head and is large enough to receive the tab, and wherein the scraper head has a second channel that does not run the depth of the scraper head and is large enough to receive the tab; and a coil spring, wherein the coil spring is disposed around the pin and is held captive between the substantially rigid member and the scraper head.

As another example, one embodiment of a method for assembling a scraper assembly comprises: providing a substantially rigid member with a pin attached thereto, wherein the pin has a tab protruding from a side of the end of the pin that is not attached to the substantially rigid member; providing a coil spring; winding the coil spring onto the pin by winding the coil spring around the tab until the coil spring is held captive between the substantially rigid member and the tab; providing a scraper head having at least one scraping surface, wherein the scraper head has a hole therethrough that is large enough to receive the pin, wherein the scraper head has a first channel that runs the depth of the scraper head and is large enough to receive the tab, and wherein the scraper head has a second channel that does not run the depth of the scraper head and is large enough to receive the tab; aligning the scraper head with the pin such that the tab is aligned with the first channel; sliding the scraper head onto the pin, thereby compressing the coil spring, until the tab passes through the scraper head; aligning the scraper head with the pin such that the tab is aligned with the second channel; and releasing the scraper head, thereby allowing the coil spring to decompress.

Figure 1:
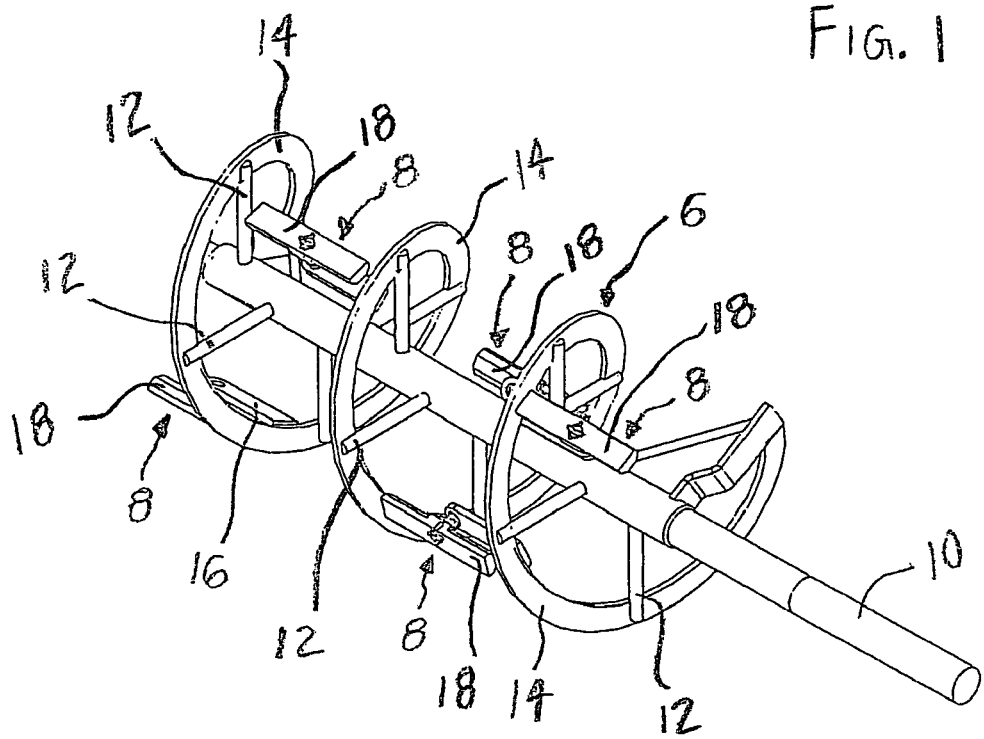
FIG. 1 is a perspective view of one embodiment of an agitator and scraper assemblies.

The foregoing summary, as well as the following detailed description of embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF CERTAIN EMBODIMENTS

Figure 2:
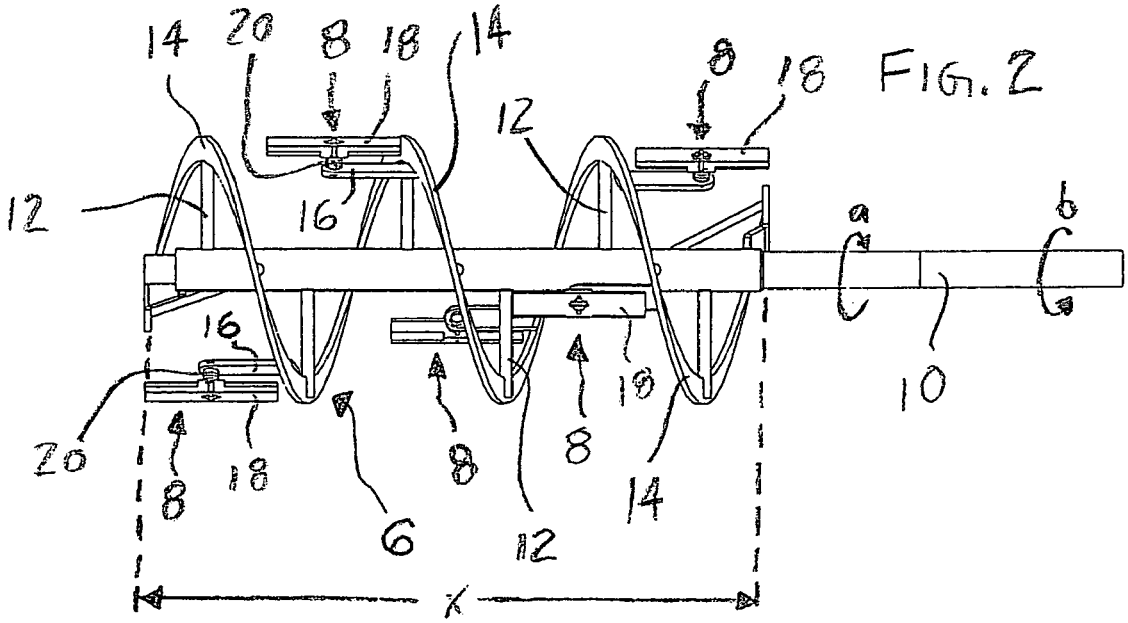
FIG. 2 is a side view of one embodiment of an agitator and scraper assemblies.
Figure 3:
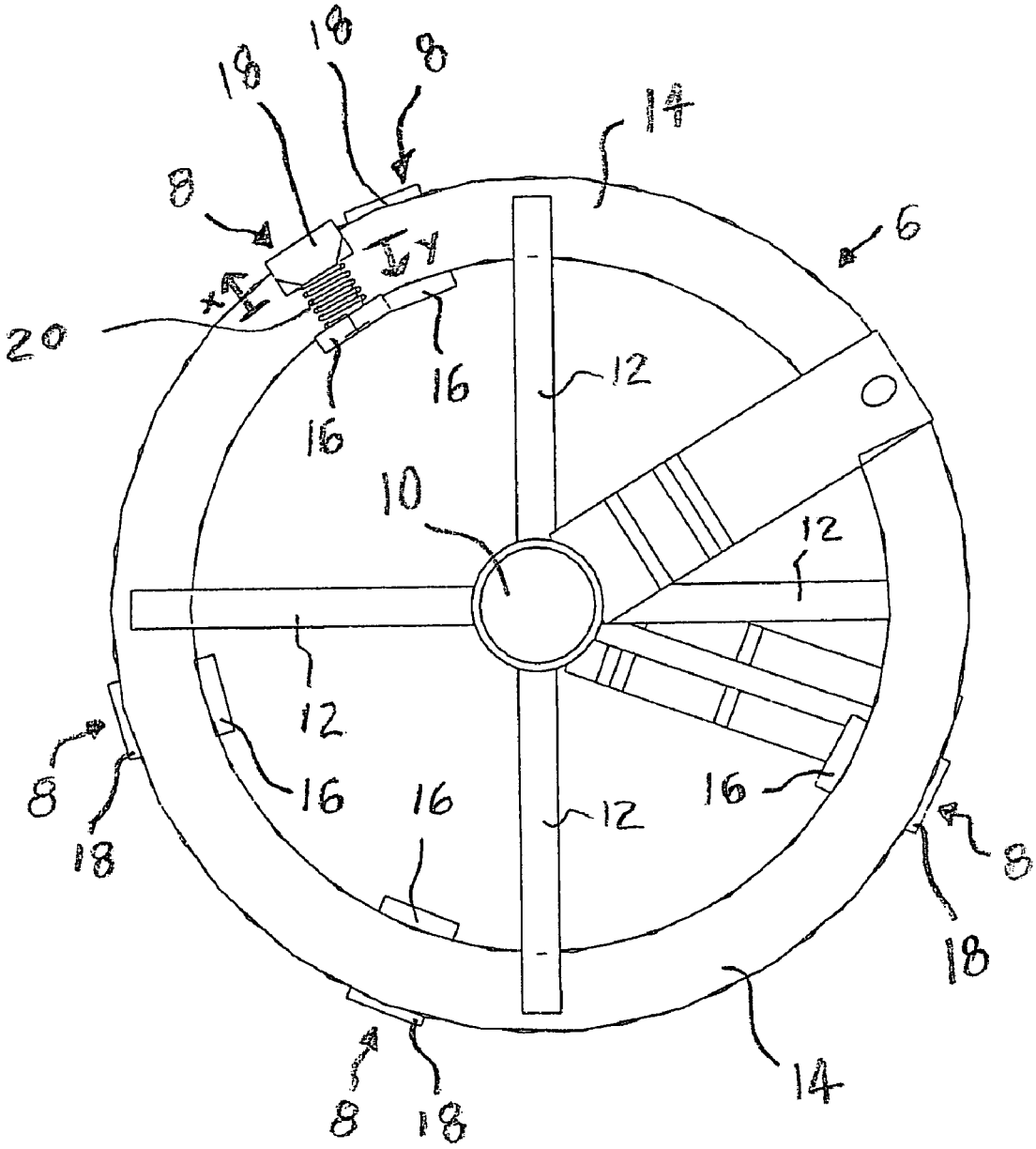
FIG. 3 is an end view of one embodiment of an agitator and scraper assemblies.

FIGS. 1-3 illustrate embodiments of an agitator 6 and scraper assemblies 8 used in accordance with the present technology. FIG. 1 is a perspective view of one embodiment of an agitator 6 and scraper assemblies 8; FIG. 2 is a side view of one embodiment of an agitator 6 and scraper assemblies 8; and FIG. 3 is an end view of one embodiment of an agitator 6 and scraper assemblies 8.

In the embodiments shown in FIGS. 1-3, the agitator 6 includes a cylindrical shaft 10, spokes 12 and a ribbon 14. The shaft 10, spokes 12 and ribbon 14 are preferably made of steel, but can also be made of other materials with steel-like characteristics. The ribbon 14 is wound helically around the shaft 10 and attached thereto by the spokes 12. The spokes 12 are attached to the shaft 10 and are also connected to the ribbon 14. The shaft 10, spokes 12 and ribbon 14 are preferably attached by welding.

In the embodiments shown in FIGS. 1-3, an agitator 6 can be used in connection with a tub, a vat or other container to blend substances. From this point on, any reference herein to a tub is also a reference to a vat or other container. Specifically, the agitator 6 can be rotated about the shaft 10 in order to rotate the spokes 12 and ribbon 14, thereby blending substances in a tub (not shown). For example, in one embodiment, a tub is a food receptacle and the substances to be blended are food items. Substances that are blended in a tub can stick to the inner surface of the tub, that is, the surface of the tub that contacts the substances that are being blended. Also, such sticking can be enhanced by the heating or cooling of the inner surface of the tub. Thus, it is desirable to scrape the inner surface of a tub during blending in order to remove substances that stick to the inner surface of the tub.

Examples of systems in which agitators can be used with tubs to blend substances include systems such as those described in U.S. Pat. No. 4,733,607, which issued to Star et al. on Mar. 29, 1988 and is entitled Food Processing Machine, and U.S. Pat. No. 5,228,775, which issued to Horn et al. on Jul. 20, 1995 and is entitled Reversing Blender Agitators.

In the embodiments shown in FIGS. 1-3, the scraper assemblies 8 are attached to the agitator 6. Specifically, the scraper assemblies 8 are attached to the ribbon 14 by a substantially rigid member 16. The substantially rigid member 16 is preferably welded to the ribbon 14 of the agitator 6. The substantially rigid member 16 is preferably attached to the ribbon 14 such that the substantially rigid member 16 is substantially parallel to the shaft 10 of the agitator 6. Further, each scraper assembly 8, as shown, includes a scraper head 18. The scraper head 18 is preferably configured to contact the inner surface of a tub (not shown). In various embodiments, a substantially rigid member that extends from a ribbon of an agitator, which agitator includes a shaft and a ribbon, is not substantially parallel to the shaft of the agitator. In such embodiments, the remaining components of the scraper assembly are configured such that the scraper head contacts the inner surface of a tub.

In the embodiment shown in FIG. 2, the scraper heads 18 are spaced such that, together, they span a distance x. In a preferred embodiment, the distance x is equal to the distance covered by the ribbon 14. In a preferred embodiment, the distance x is also equal to the length of a tub (not shown). The spacing of the scraper heads 18, as shown in FIG. 2, allows the entire distance x to be scraped once for every full rotation of the agitator 6 in either direction a or direction b. When the agitator 6 is rotated in direction a or direction b, the scraper heads 18 can rock somewhat, which can allow the scraper heads 18 to maintain contact with the inner surface of a tub (not shown).

The embodiment shown in FIG. 2, has five scraper assemblies 8. In a preferred embodiment using five scraper assemblies, each scraper head 18 is about eight inches long and about two inches wide. In various embodiments, any number of scraper assemblies may be employed to cover a given distance. That is, the shorter the scraper heads, the more scraper assemblies that will be required to cover the same distance. Likewise, the longer the scraper heads, the fewer scraper assemblies that will be required to cover the same distance. Scraper heads need not be eight inches long and two inches wide and scraper heads need not be proportioned such that the length is four times the width. That is, scraper heads can come in any length and width that is sufficient for a given application. For example, it may be desirable to vary scraper head length and/or width based on what substances are being blended and/or the size of a tub. In various embodiments, scraper heads of different sizes can be used for a given application.

In the embodiment shown in FIG. 3, the scraper heads 18 protrude beyond the ribbon 14. It is preferred that the scraper heads 18, and not the ribbon 14, contact the inner surface of a tub (not shown). The clearance between the ribbon 14 and a tub (not shown) can vary due to imperfections in the inner surface of a tub. Likewise, the distance the scraper head 18 protrudes beyond the ribbon 14 can vary with the actual clearance between the ribbon 14 and a tub (not shown). For example, in one embodiment, the scraper head 18 protrudes about 3/16 of an inch beyond the ribbon 14 and, thus, there is about 3/16 of an inch of clearance between the ribbon 14 and the tub (not shown). In such an example, the clearance between the ribbon 14 and the tub (not shown) can vary, thereby becoming greater and/or less than 3/16 of an inch, due to imperfections in the inner surface of the tub. In such an example, when the clearance between the ribbon 14 and the tub (not shown) becomes greater than 3/16 of an inch, the scraper head 18 can deflect in a direction x, thereby decompressing a spring 20, in order to maintain contact with the tub (not shown). In such an example, when the clearance between the ribbon 14 and the tub (not shown) becomes less than 3/16 of an inch, the scraper head 18 can deflect in a direction y, thereby compressing a spring 20, in order to maintain contact with the tub (not shown). In various embodiments, the clearance between a ribbon 14 and a tub can be greater or less than 3/16 of an inch.

Figure 4:
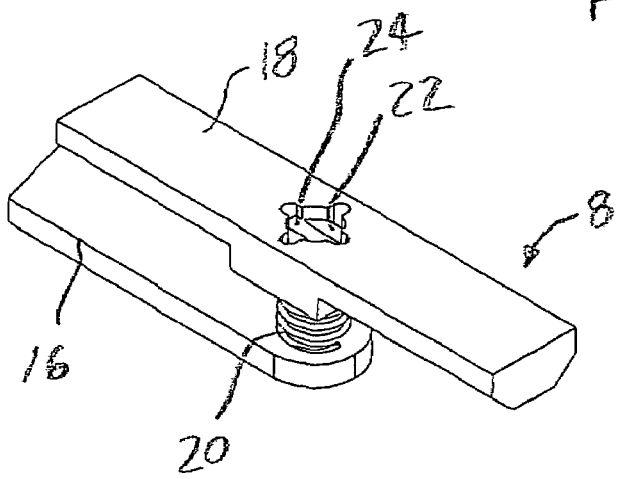
FIG. 4 is a perspective view of one embodiment of a scraper assembly.
Figure 5:
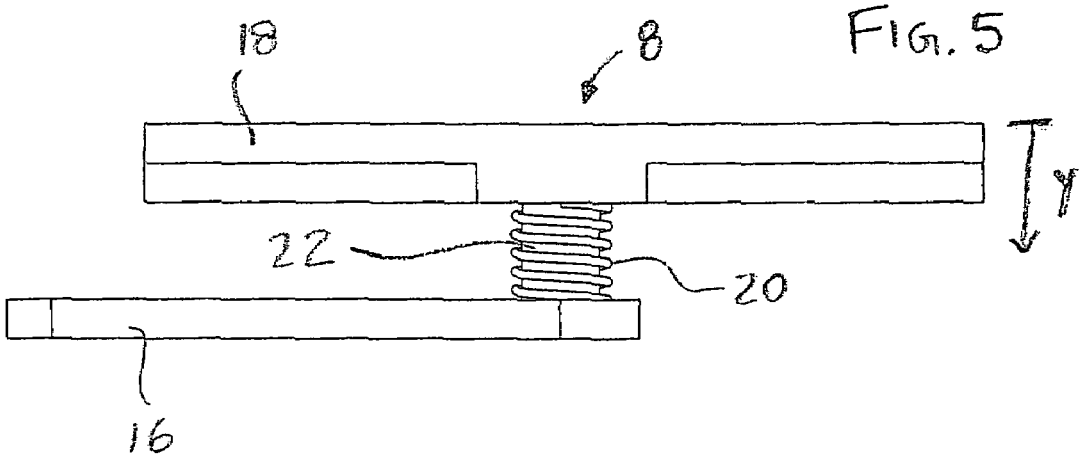
FIG. 5 is a side view of one embodiment of a scraper assembly.
Figure 6:
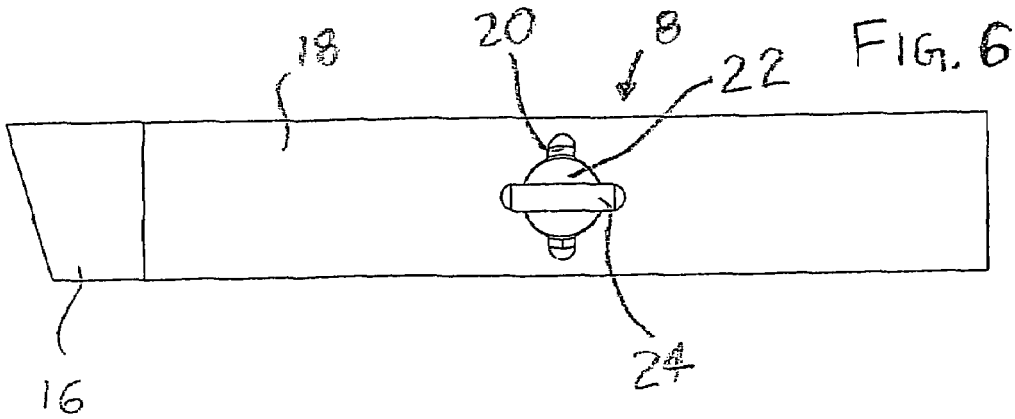
FIG. 6 is a bottom view of one embodiment of a scraper assembly.

FIGS. 4-6 illustrate embodiments of scraper assemblies used in accordance with the present technology. FIG. 4 is a perspective view of a scraper assembly; FIG. 5 is a side view of a scraper assembly; and FIG. 6 is a bottom view of a scraper assembly. In the embodiments shown in FIGS. 4-6, a scraper assembly 8 includes a substantially rigid member 16, a scraper head 18, a coil spring 20, a pin 22 and a keeper 24. The substantially rigid member 16 is attached to the pin 22. The substantially rigid member 16 is preferably welded to the pin 22. The substantially rigid member 16 is preferably attached to the pin 22 such that the pin 22 is substantially perpendicular to the substantially rigid member 16. The keeper 24 is attached to the pin 22. The keeper 24 is preferably welded to the pin 22. The keeper 24 is preferably attached to the pin 22 such that the keeper 24 is substantially parallel to the substantially rigid member 16 (shown in FIG. 4) and both ends of the keeper 24 protrude beyond the outer wall of the pin 22 (shown in FIG. 6).

In the embodiment shown in FIG. 5, the coil spring 20 is held captive between the scraper head 18 and the substantially rigid member 16. In this embodiment, the coil spring 20 is not fully decompressed (not in its fully relaxed state). That is, the coil spring 20 would decompress further (to its relaxed state) if the coil spring 20 were not held captive between the scraper head 18 and the substantially rigid member 16. Thus, the coil spring 20 is exerting a force on the scraper head 18. Further, in the embodiment shown in FIG. 5, the coil spring 20 is not fully compressed. That is, if a force is exerted on the scraper head 18 in direction y, the scraper head 18 will deflect in direction y, thereby further compressing the coil spring 20. Thus, when a scraper head 18 contacts the inner surface of a tub (not shown), and the scraper head 18 deflects, the scraper head 18 exerts a force on the inner surface of the tub (not shown).

In various embodiments, the amount of force that a scraper head 18 exerts on the inner surface of a tub (not shown) can be changed by using a spring with a different spring constant. The deflection also allows the scraper head 18 to maintain contact with the inner surface of a tub (not shown) despite imperfections in the inner surface of the tub (not shown).

Figure 7:
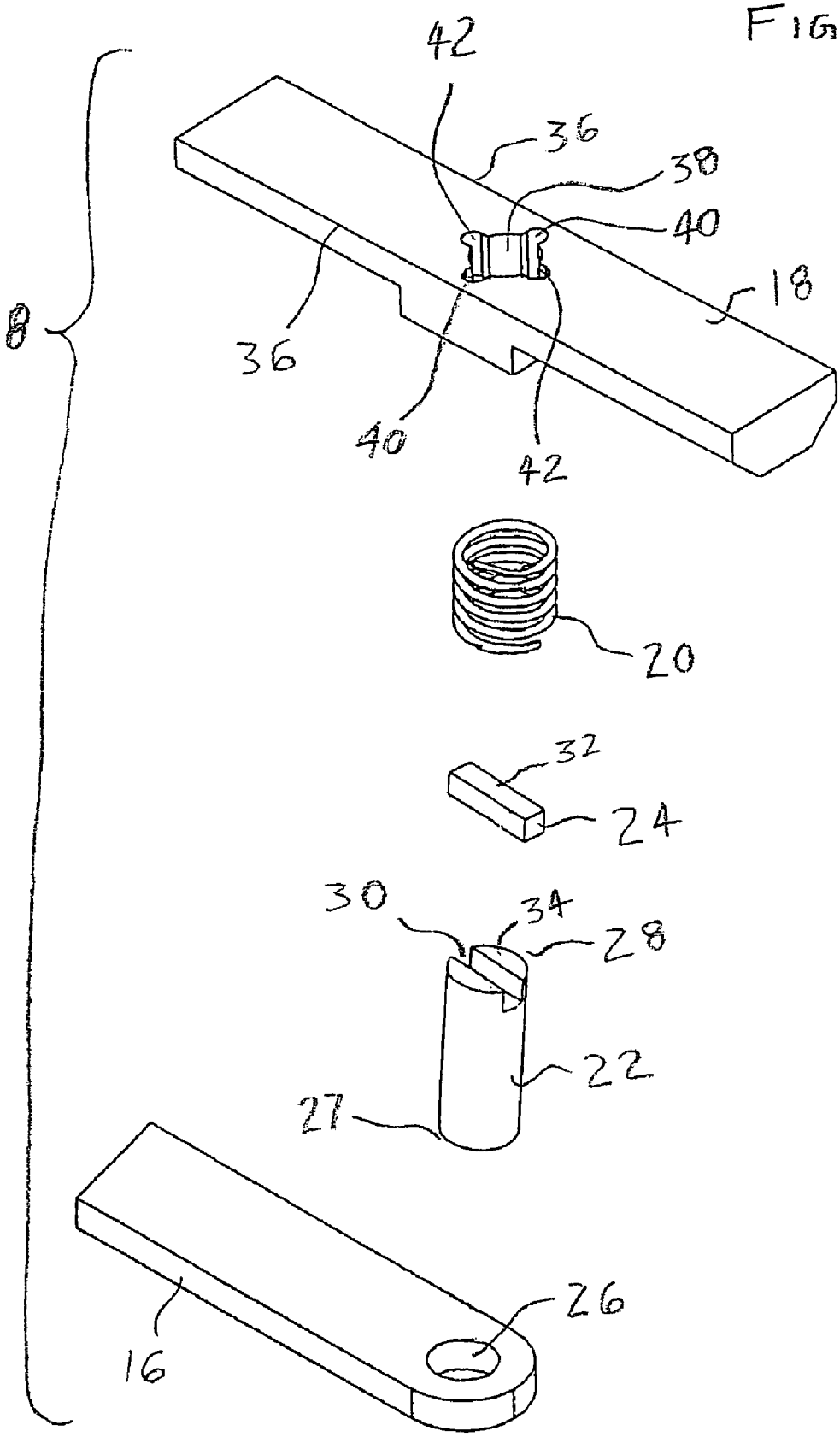
FIG. 7 is an exploded view of one embodiment of a scraper assembly.

FIG. 7 is an exploded view of one embodiment of a scraper assembly 8 used in accordance with the present technology. As shown in FIG. 7, the scraper assembly 8 includes a substantially rigid member 16, a pin 22, a keeper 24, a coil spring 20 and a scraper head 18.

In the embodiment shown in FIG. 7, the substantially rigid member 16 has a hole 26 therethrough. The hole 26 is configured to receive the pin 22. The hole 26 is preferably circular to receive a cylindrical pin 22. In various embodiments, the hole can be any shape and the pin can be any corresponding shape. In other embodiments, a substantially rigid member can have a space therein, such as a slot, groove, or other indentation, to receive a pin that does not pass completely through the substantially rigid member. In another example, the substantially rigid member can be solid and the pin can be welded to the surface of the substantially rigid member.

In the embodiment shown in FIG. 7, the pin 22 is a cylinder with a first end 27 and a second end 28 with a channel 30 therethrough. The first end 27 of the pin 22 is inserted into the hole 26 and attached to the substantially rigid member 16. The pin 22 is preferably welded to the substantially rigid member 16. The pin 22 is preferably attached to the substantially rigid member 16 such that the pin 22 is substantially perpendicular to the substantially rigid member 16.

In the embodiment shown in FIG. 7, the keeper 24 is a member that fits inside the channel 30. The keeper 24 preferably fits inside the channel 30 such that the top 32 of the keeper 24 and the top 34 of the pin 22 create a flat surface. The keeper 24 preferably fits inside the channel 30 such that the ends of the keeper 24 protrude beyond the sides of the pin 22, thereby forming tabs at one end of the pin. The keeper 24 can be attached to the pin 22. The keeper 24 is preferably attached to the pin 22 by welding.

In various embodiments, a pin and keeper can be a unitary member. In such embodiments, the unitary member is a pin with at least one tab protruding from a side of one end of the pin. In various embodiments, the unitary member can be configured such that any number of tabs protrude from a side of one end of the pin.

In various embodiments, a substantially rigid member, a pin and a keeper can be a unitary member. In such embodiments, the unitary member is a bar (round or flat) with a pin protruding substantially perpendicular to the length of the bar, and the pin has at least one tab protruding from a side of the end of the pin that is furthest from the bar. In various embodiments, the unitary member can be configured such that any number of tabs protrude from a side of the end of the pin that is furthest from the bar.

In various embodiments, a ribbon of an agitator, a substantially rigid member, a pin and a keeper can be a unitary member. In such embodiments, the unitary member is a helically wound ribbon with a bar (round or flat) extending therefrom that has a pin protruding substantially perpendicular to the length of the bar, and the pin has at least one tab protruding from a side of the end of the pin that is furthest from the bar. In various embodiments, the unitary member can be configured such that any number of tabs protrude from a side of the end of the pin that is furthest from the bar.

In the embodiment shown in FIG. 7, the coil spring 20 can be wound onto the pin 22 by twisting the coil spring 20 around the protruding ends of the keeper 24, akin to twisting a key onto a key chain. Once the coil spring 20 is wound onto the pin 22, the coil spring 20 is held captive between the substantially rigid member 16 and the protruding ends of the keeper 24. The coil spring 20 is preferably made of steel, but can also be made of other materials with steel-like characteristics. In other embodiments, the coil spring 20 can be slid onto the pin 22 prior to attaching the pin 22 to the substantially rigid member 16. In such an embodiment, once the pin 22 is attached to the substantially rigid member 16, the coil spring 20 is held captive between the substantially rigid member 16 and the protruding ends of the keeper 24.

In the embodiment shown in FIG. 7, the scraper head 18 preferably has two scraping edges 36 that run the length of the scraper head 18. The scraper head 18 can be configured such that the scraping edges 36 provide scraping in two directions. In various embodiments, the scraper head 18 can have a single scraping edge. In such embodiments, the scraper head 18 can be configured such that the scraping edge provides scraping in one direction.

In the embodiment shown in FIG. 7, the scraper head 18 has a hole 38 therethrough. The hole 38 is large enough to receive the pin 22, but not large enough to receive the coil spring 20. On two sides of the hole 38 (180 degrees apart—around the circumference of the hole 38), there are channels 40 that run the depth of the scraper head 18. On another two sides of the hole 38 (180 degrees apart—around the circumference of the hole 38), there are channels 42 that do not run the depth of the scraper head 18. As shown in FIG. 7, the channels 40 that run the depth of the scraper head 18 are 90 degrees apart (around the circumference of the hole 38) from the channels 42 that do not run the depth of the scraper head 18. In various embodiments, channels that run the depth of a scraper head with a hole therethrough need not be 90 degrees apart (around the circumference of the hole therethrough) from channels that do not run the depth of a scraper head. In such embodiments, other degrees of separation are sufficient to allow the scraper head to be attached to the rest of the scraper assembly.

In various embodiments, the scraper head can be modified to accommodate any number of tabs protruding from the pin, that is, a corresponding channel that runs the depth of the scraper head and a corresponding channel that does not run the depth of the scraper head can be included in the hole therethrough for each tab.

In the embodiment shown in FIG. 7, the scraper head 18 is attached to the rest of the scraper assembly by aligning the channels 40 that run the depth of the scraper head 18 with the protruding ends of the keeper 24. The scraper head 18 is then slid toward the substantially rigid member 16, thereby compressing the coil spring 20, until the protruding ends of the keeper 24 pass all the way through the scraper head 18. The scraper head 18 is then turned 90 degrees such that the channels 42 that do not run the depth of the scraper head 18 are aligned with the protruding ends of the keeper 24. The scraper head 18 is then allowed to slide away from the substantially rigid member 16, thereby allowing the coil spring 20 to decompress, until the protruding ends of the keeper 24 contact the end of the channels 42 that do not run the depth of the scraper head 18.

In the embodiment shown in FIG. 7, the scraper head 18 is removed from the rest of the scraper assembly by sliding the scraper head 18 toward the substantially rigid member 16, thereby compressing the coil spring 20, until the protruding ends of the keeper 24 pass all the way through the scraper head 18. The scraper head 18 is then turned 90 degrees such that the channels 40 that run the depth of the scraper head 18 are aligned with the protruding ends of the keeper 24. The scraper head 18 is then allowed to slide away from the substantially rigid member, thereby allowing the coil spring 20 to decompress, until the protruding ends of the keeper 24 are removed from the scraper head 18.

In the embodiment shown in FIG. 7, once the scraper head 18 is removed, the coil spring 20 can be removed by winding the coil spring 20 off the pin 22 by twisting the coil spring 20 around the protruding ends of the keeper 24, akin to twisting a key off of a key chain.

In the embodiment shown in FIG. 7, once the coil spring 20 and the scraper head 18 are removed from the rest of the scraper assembly, the rest of the scraper assembly can be cleaned and/or a new coil spring and/or scraper head can be attached to the rest of the scraper assembly.

Figure 8:
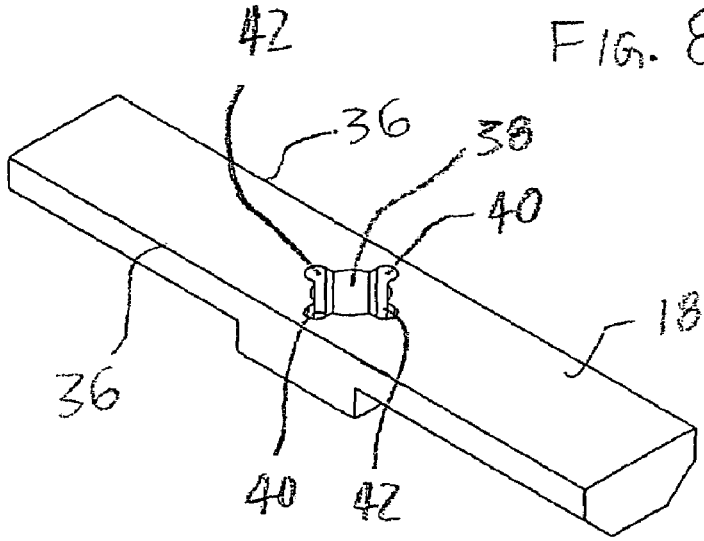
FIG. 8 is a perspective view of one embodiment of a scraper head.
Figure 9:
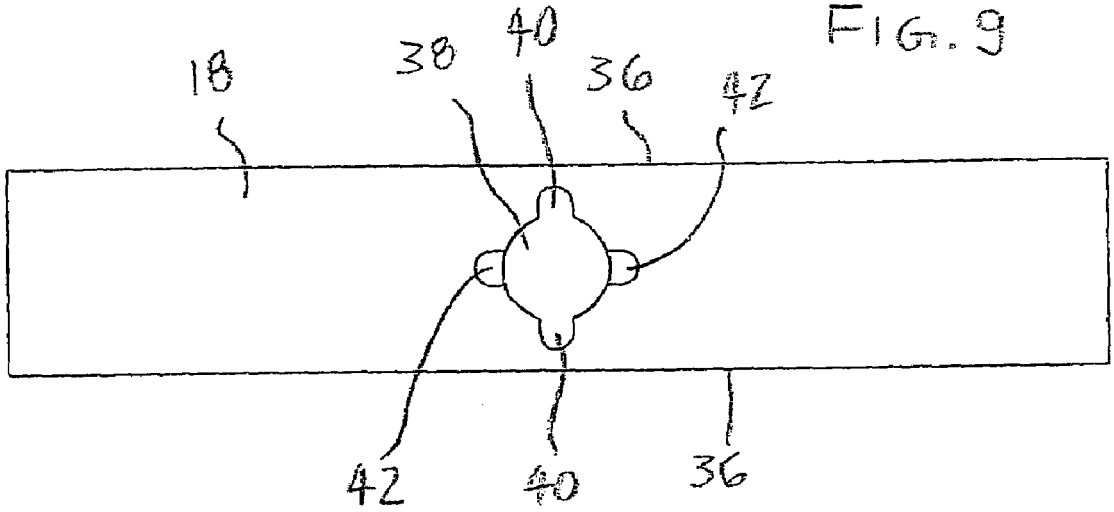
FIG. 9 is a bottom view of one embodiment of a scraper head.
Figure 10:
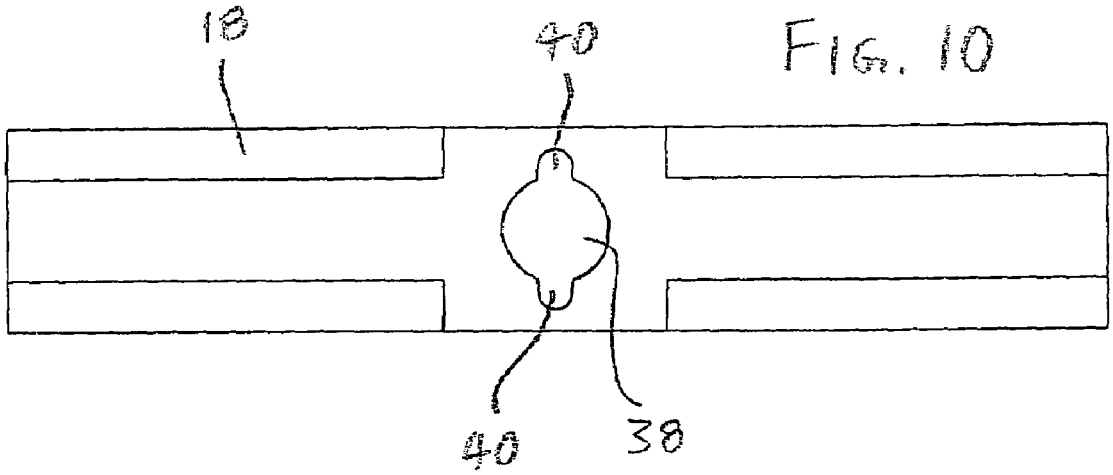
FIG. 10 is a top view of one embodiment of a scraper head.

FIGS. 8-10 illustrate embodiments of a scraper head 18 used in accordance with the present technology. FIG. 8 is a perspective view of one embodiment of a scraper head 18; FIG. 9 is a bottom view of one embodiment of a scraper head 18; and FIG. 10 is a top view of one embodiment of a scraper head 18. FIGS. 8-10 show aspects of a scraper head 18 that are discussed with regard to FIG. 7. For example, the channels 40 that run the depth of the hole 38 are shown in both FIG. 9 (bottom view) and FIG. 10 (top view), however, the channels 42 that do not run the depth of the hole 38 are shown in FIG. 9 (bottom view), but not FIG. 10 (top view).

In the embodiments shown in FIGS. 8-10, the scraper head 18 is preferably made of nylon. In various embodiments, scraper heads can be made of other materials, including but not limited to, other types of plastics. One such example is Peek, a commercially available brand of plastic that is manufactured by Victrex plc, a company with manufacturing plants and research facilities in the UK and sales and distributions centers worldwide. Peek, for example, can be used in scraper heads that are utilized in high temperature environments. Scraper heads can also be made of metals, such as steel or other materials with steel-like characteristics, and then coated with plastic, for example.

Figure 11:
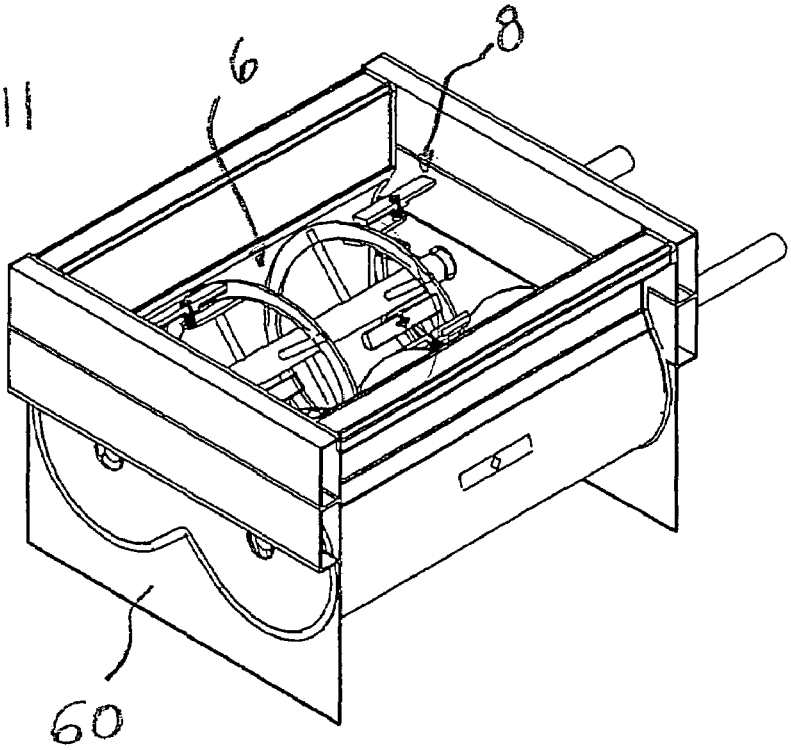
FIG. 11 is a perspective view of one embodiment of agitators and scraper assemblies disposed within a tub.
Figure 12:
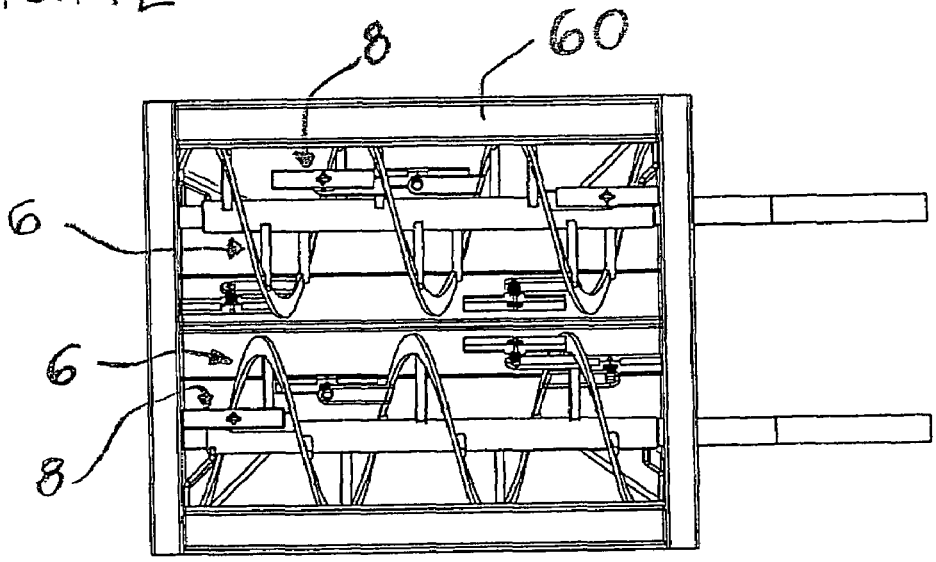
FIG. 12 is a top view of one embodiment of agitators and scraper assemblies disposed within a tub.

FIG. 11 is a perspective view of one embodiment of agitators 6 and scraper assemblies 8 disposed within a tub 60. FIG. 12 is a top view of one embodiment of agitators 6 and scraper assemblies 8 disposed within a tub 60. In FIGS. 11 and 12, two agitators 6 are disposed next to each other within a tub 60. In other embodiments, any number of agitators can be used depending upon the size of the tub. In the embodiments shown in FIGS. 11 and 12, the inner surface of the tub 60 conforms at least in part to the general cylindrical shape of the agitators 6. This embodiment can be used with the preferred embodiment described above in connection with FIGS. 2 and 3.

While the above discussion describes the invention with reference to embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A blending system comprising:

a tub having an inner surface;

an agitator having a shaft and a ribbon wound helically around said shaft, wherein said agitator is disposed within said tub such that said agitator can be rotated about said shaft without contacting said inner surface of said tub; and a scraper assembly comprising:

a substantially rigid member, wherein said substantially rigid member is attached to said ribbon;

a pin with a first end and a second end, wherein a tab protrudes from a side of said first end and said second end is attached to said substantially rigid member;

a scraper head having at least one scraping surface, wherein said scraping surface contacts said inner surface of said tub, wherein said scraper head has a hole therethrough that is large enough to receive said pin, wherein said scraper head has a first channel that runs the depth of the scraper head and is large enough to receive said tab, and wherein said scraper head has a second channel that does not run the depth of the scraper head and is large enough to receive said tab; and a coil spring, wherein said coil spring is disposed around said pin and is held captive between said substantially rigid member and said scraper head.

2. The system of claim 1, wherein said pin has two tabs that protrude from opposite sides of said first end.

3. The system of claim 2, wherein said scraper head has a third channel that runs the depth of the scraper head and is large enough to receive one of said tabs, and wherein said scraper head has a fourth channel that does not run the depth of the scraper head and is large enough to receive one of said tabs.

4. The scraper assembly of claim 3, wherein said first channel and said third channel are spaced one hundred and eighty degrees apart around the circumference of said hole, wherein said second channel and said fourth channel are spaced one hundred and eighty degrees apart around the circumference of said hole, and wherein said first channel and said second channel are spaced ninety degrees apart around the circumference of said hole.

5. The system of claim 1, wherein said substantially rigid member is welded to said ribbon and said pin is welded to said substantially rigid member.

6. The scraper assembly of claim 1, wherein said pin is substantially perpendicular to said substantially rigid member.

7. The system of claim 1, wherein said scraper head is composed of nylon.

8. The system of claim 1, wherein said scraper head is composed of Peek.

9. The system of claim 1, wherein said scraper head is composed of metal coated with plastic.

10. A scraper assembly for use in a blending system, said scraper assembly comprising:

a substantially rigid member;

a pin with a first end and a second end, wherein a tab protrudes from a side of said first end and said second end is attached to said substantially rigid member;

a scraper head having at least one scraping surface, wherein said scraper head has a hole therethrough that is large enough to receive said pin, wherein said scraper head has a first channel that runs the depth of the scraper head and is large enough to receive said tab, and wherein said scraper head has a second channel that does not run the depth of the scraper head and is large enough to receive said tab; and a coil spring, wherein said coil spring is disposed around said pin and is held captive between said substantially rigid member and said scraper head.

11. The scraper assembly of claim 10, wherein said pin has two tabs that protrude from opposite sides of said first end.

12. The scraper assembly of claim 11, wherein said scraper head has a third channel that runs the depth of the scraper head and is large enough to receive one of said tabs, and wherein said scraper head has a fourth channel that does not run the depth of the scraper head and is large enough to receive one of said tabs.

13. The scraper assembly of claim 12, wherein said first channel and said third channel are spaced one hundred and eighty degrees apart around the circumference of said hole, wherein said second channel and said fourth channel are spaced one hundred and eighty degrees apart around the circumference of said hole, and wherein said first channel and said second channel are spaced ninety degrees apart around the circumference of said hole.

14. The scraper assembly of claim 10, wherein said pin is welded to said substantially rigid member.

15. The scraper assembly of claim 10, wherein said pin is substantially perpendicular to said substantially rigid member.

16. The scraper assembly of claim 10, wherein said scraper head is composed of nylon.

17. The scraper assembly of claim 10, wherein said scraper head is composed of Peek.

18. The scraper assembly of claim 10, wherein said scraper head is composed of metal coated with plastic.

19. A method for assembling a scraper assembly comprising:

providing a substantially rigid member with a pin attached thereto, wherein the pin has a tab protruding from a side of the end of the pin that is not attached to the substantially rigid member;

providing a coil spring;

winding said coil spring onto said pin by winding said coil spring around said tab until said coil spring is held captive between said substantially rigid member and said tab;

providing a scraper head having at least one scraping surface, wherein said scraper head has a hole therethrough that is large enough to receive said pin, wherein said scraper head has a first channel that runs the depth of the scraper head and is large enough to receive said tab, and wherein said scraper head has a second channel that does not run the depth of the scraper head and is large enough to receive said tab;

aligning said scraper head with said pin such that said tab is aligned with said first channel;

sliding said scraper head onto said pin, thereby compressing said coil spring, until said tab passes through said scraper head;

aligning said scraper head with said pin such that said tab is aligned with said second channel; and releasing said scraper head, thereby allowing said coil spring to decompress.

20. The method of claim 19 wherein said pin is welded to said substantially rigid member.

* * * * *

UNITED STATES PATENT AND TRADEMARK OFFICE

CERTIFICATE OF CORRECTION

PATENT NO. : 7,585,105 B2
APPLICATION NO. : 11/446703
DATED : September 8, 2009
INVENTOR(S) : Tim V. Reinecke It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 761 days.

Signed and Sealed this

Fourteenth Day of September, 2010

David J. Kappos

David J. Kappos
*Director of the United States Patent and Trademark Office*